US009010581B2

(12) United States Patent
Presche

(10) Patent No.: US 9,010,581 B2
(45) Date of Patent: Apr. 21, 2015

(54) DISPENSER HAVING A ROTATIONAL LOCK

(75) Inventor: Martin Presche, Dinklage (DE)

(73) Assignee: RPC Bramlage GmbH, Lohne (DE)

( * ) Notice: Subject to any disclaimer, the term of this patent is extended or adjusted under 35 U.S.C. 154(b) by 192 days.

(21) Appl. No.: 13/809,632

(22) PCT Filed: Jul. 12, 2011

(86) PCT No.: PCT/EP2011/003479
§ 371 (c)(1),
(2), (4) Date: Mar. 28, 2013

(87) PCT Pub. No.: WO2012/016629
PCT Pub. Date: Feb. 9, 2012

(65) Prior Publication Data

US 2013/0200107 A1 Aug. 8, 2013

(30) Foreign Application Priority Data

Jul. 12, 2010 (DE) ..... 10 2010 036 352

(51) Int. Cl.
*B67B 1/00* (2006.01)
*B05C 11/00* (2006.01)
*B05B 11/00* (2006.01)

(52) U.S. Cl.
CPC ..... *B05C 11/00* (2013.01); *B05B 11/0032* (2013.01); *B05B 11/3021* (2013.01); *B05B 11/3047* (2013.01); *B05B 11/3052* (2013.01); *B05B 11/3053* (2013.01); *B05B 11/3059* (2013.01); *B05B 11/3074* (2013.01)

(58) Field of Classification Search
CPC ..... B05B 11/0027–11/0032; B05B 11/3001; B05B 11/3021; B05B 11/3047; B05B 11/3052; B05B 11/3059; B05B 11/3074
USPC ..... 222/153.13, 256, 320, 321.1, 321.7, 222/383.1, 384, 386, 519, 538
See application file for complete search history.

(56) References Cited

U.S. PATENT DOCUMENTS 1,903,464 A * 4/1933 Konanz ..... 222/551
3,471,066 A * 10/1969 Micallef ..... 222/519
(Continued)

FOREIGN PATENT DOCUMENTS

DE 10 2007 007 402 8/2007
FR 2 953 497 6/2011
(Continued)

OTHER PUBLICATIONS

International Search Report of PCT/EP2011/003479, Jan. 18, 2012.
(Continued)

*Primary Examiner* — Paul R Durand
*Assistant Examiner* — Randall Gruby
(74) *Attorney, Agent, or Firm* — Collard & Roe, P.C.

(57) ABSTRACT

A dispenser for dispensing liquid to pasty compositions, has a dispensing head, which has a dispensing mouth, and with a reservoir and a dispenser head part. The dispensing head is movable relative to the dispenser head part from a dispensing stand-by position to a lowered position and vice versa. In order to design and develop a dispenser in such a way that the dispensing mouth is oriented without relative rotation or without at least substantial relative rotation with respect to the dispenser sleeve part when the dispensing head is extended, the dispenser head part moves the dispensing head in and out only axially.

5 Claims, 6 Drawing Sheets

(56) References Cited

U.S. PATENT DOCUMENTS

| | | | | |
|---|---|---|---|---|
| 3,759,426 | A * | 9/1973 | Kane et al. | 222/385 |
| 4,779,774 | A * | 10/1988 | Morel | 222/522 |
| 4,889,262 | A * | 12/1989 | Toms | 222/153.13 |
| 5,152,425 | A * | 10/1992 | Baudin | 222/1 |
| 5,499,747 | A * | 3/1996 | Quennessen | 222/167 |
| 5,749,496 | A * | 5/1998 | DeJonge et al. | 222/153.14 |
| 6,290,103 | B1 * | 9/2001 | Fraillon | 222/321.1 |
| 8,152,026 | B2 * | 4/2012 | Ki | 222/153.13 |
| D675,105 | S * | 1/2013 | Chen | D9/688 |
| D696,962 | S * | 1/2014 | Chen | D9/688 |
| D696,963 | S * | 1/2014 | Chen | D9/688 |
| 2003/0010793 | A1 * | 1/2003 | Ritsche | 222/153.1 |
| 2007/0246484 | A1 * | 10/2007 | Yoshida et al. | 222/153.13 |
| 2008/0023498 | A1 * | 1/2008 | Bertin et al. | 222/402.12 |
| 2009/0071985 | A1 * | 3/2009 | Ki | 222/309 |
| 2009/0120963 | A1 * | 5/2009 | Bae | 222/153.13 |
| 2011/0031282 | A1 | 2/2011 | Hagen | |
| 2012/0024899 | A1 * | 2/2012 | Michaux et al. | 222/153.13 |
| 2012/0292344 | A1 | 11/2012 | Bertin et al. | |
| 2013/0056503 | A1 * | 3/2013 | Hagen | 222/526 |
| 2013/0140330 | A1 * | 6/2013 | Christophe et al. | 222/153.13 |
| 2013/0256338 | A1 * | 10/2013 | Moreau | 222/153.14 |

FOREIGN PATENT DOCUMENTS

| | | |
|---|---|---|
| WO | WO 2008/010640 | 1/2008 |
| WO | WO 2009/127651 | 10/2009 |

OTHER PUBLICATIONS

English translation of International Preliminary Report on Patentability of PCT/EP2011/003479, Feb. 25, 2013.

Response by the German patent attorney regarding an Office Action of the European Patent Office dated May 8, 2012 in PCT/EP2011/003479 (with English translation of the relevant parts of same).

Response by the German patent attorney regarding an Office Action of the European Patent Office dated Nov. 6, 2012 in PCT/EP2011/003479 (with English translation of the relevant parts of same).

* cited by examiner 1
3
VI
31
VI
41
40
2
VI
VI
12

DISPENSER HAVING A ROTATIONAL LOCK

CROSS REFERENCE TO RELATED APPLICATIONS

This application is the National Stage of PCT/EP2011/003479 filed on Jul. 12, 2011, which claims priority under 35 U.S.C. §119 of German Application No. 10 2010 036 352.9 filed on Jul. 12, 2010, the disclosure of which is incorporated by reference. The international application under PCT article 21(2) was not published in English.

The invention relates to a dispenser for dispensing liquid or pasty substances, with a dispensing head having a dispensing mouth, and with a reservoir and a dispenser head part, the dispensing head being movable relative to the dispenser head part from a dispenser stand-by position into a lowered position and vice versa.

Such dispensers have already become known in different configurations. For example, reference is made to WO 2009/127651 A1. Furthermore, reference is to be made to DE 10 2007 007 402 A1.

In the case of the dispenser known from the mentioned published WO specification, the dispenser head part is rotatably movable relative to a dispenser sleeve part located therebelow. Here, the dispenser head part moves only horizontally. Also, the dispenser head part is provided with the same outer diameter as the dispenser sleeve part. Thus, in the retracted state, a virtually uniform round column stands up.

The aforementioned features, individually or in combination, are also provided in a preferred manner within the context of the present application. In the case of the dispenser known from the mentioned published WO specification, it is further provided that the dispensing head, in the course of moving out and in, rotates together with the dispenser head part. The result of this is that when the dispensing head is extended, the user finds a dispensing mouth, that is formed in the dispensing head and opens in the radial direction, to be in a position that is peripherally offset with respect to the retracted position of the dispensing head and with regard to the part that usually is held in a second hand and that forms the reservoir, thus specifically the dispenser sleeve part.

Based on this, the invention is concerned with the technical problem of configuring and improving a dispenser as mentioned above and as known in principle from the mentioned published WO specification in such a manner that when the dispensing head is extended, the dispensing mouth, without relative rotation or at least without substantial relative rotation, is aligned with respect to the dispenser sleeve part.

A possible solution to this technical problem is given according to a first inventive idea in the case of the subject matter of claim 1, this being in this case based on the fact that the dispenser head part moves the dispensing head in and out only axially. When moving out or in, the dispensing head does not perform the rotational movement of the dispenser head part, which rotational movement is in principle given in the case of the dispenser according to the mentioned published WO specification. The dispensing head remains stationary relative to the dispenser head part.

For this purpose, the dispensing head is preferably connected in a rotationally locked manner to a stationary dispenser part such as, for example, the dispenser sleeve part or the pump chamber. However, the connection nevertheless enables an axial relative movement between the dispensing head and the stationary dispenser part. The invention takes the middle course of providing the entire dispensing head, including the dispensing mouth, such that it is movable only axially. Relative to a reservoir and/or a pump chamber, in particular, in addition or as an alternative however, stationary relative to a part that is firmly held by another hand of the user during actuation, there is no relative movement in the peripheral direction during the axial displacement of the dispensing head.

Moving in and out can be achieved in different ways. For example, the dispensing head can be coupled to the dispenser head part by way of a wire so that during the rotational movement of the dispenser head part, an axial outward movement of the dispensing head is effected by means of the wire, which dispensing head can then move in again, for example, against a spring force. For example, a pinion and rack coupling can also be provided. In this case, for example, a pinion that is fixedly connected to a dispenser part outside of the dispenser head and the dispenser head part and that has a horizontal axis can interact with a vertical rack formed on the dispensing head, wherein a toothing provided on the dispensing head (on the inside), that extends horizontally and peripherally, can interact with the pinion.

However, it is preferred that the dispensing head is moved only axially by means of a slotted guide between the dispensing head and the dispenser head part.

Further features of the invention are described or illustrated hereinafter, also in the description of the figures or the drawing, often in their preferred association with the already explained claim concept; however, they can also be of importance in association with only one or a plurality of individual features that are described or illustrated here in drawings, or can be of importance independently or in a different overall concept.

Thus, it is preferred that with regard to a dispensing mouth of the dispensing head, which dispensing mouth projects at least partially relative to an engaging wall, the dispenser head part has a retraction opening that has delimiting surfaces for a movement of the dispensing mouth relative to the dispenser head part, said delimiting surfaces running obliquely to a vertical. Based on the described kinematics and the resulting relative movements between the dispensing head and the dispenser head part, moving of the dispensing head into and out of the dispenser head part can be achieved in a simple manner, even in the region of the dispensing mouth. As an alternative or in addition, it is also possible, where applicable only, that a chamfer is formed in the peripheral direction on the projecting portion of the dispensing mouth and, where applicable, that only the opening width of the region of the dispenser head part, which region accommodates the dispensing mouth in the retracted state, is just large enough. Thus, in the retracted state, a planar end for adjacent surfaces on the upper side can be achieved between the dispensing mouth or a dispensing head portion that forms the dispensing mouth, in so far as this projects radially, and an associated inwardly facing radial edge region of the dispenser head part.

In a further detail it is also preferred that between the dispenser head part and the dispensing head a rotatable sleeve is provided for achieving the vertical movement of the dispensing head. The rotatable sleeve is then preferably rotatable relative to the dispenser reservoir and/or the pump chamber. Furthermore, said sleeve preferably acts on the dispensing head and is acted upon by means of the dispenser head part.

Furthermore, in the course of the rotation, the sleeve can carry out an axial movement. By this, an axial displacement of the dispensing head can be achieved which is significantly greater compared with the angular movement of the dispenser head part while nevertheless still [maintaining] in the course of the handling an advantageous oblique angle of a slotted guide, if this configuration is used.

The invention is explained below with reference to the accompanying drawing which, however, merely illustrates an exemplary embodiment. In the figures.

Figure 1:
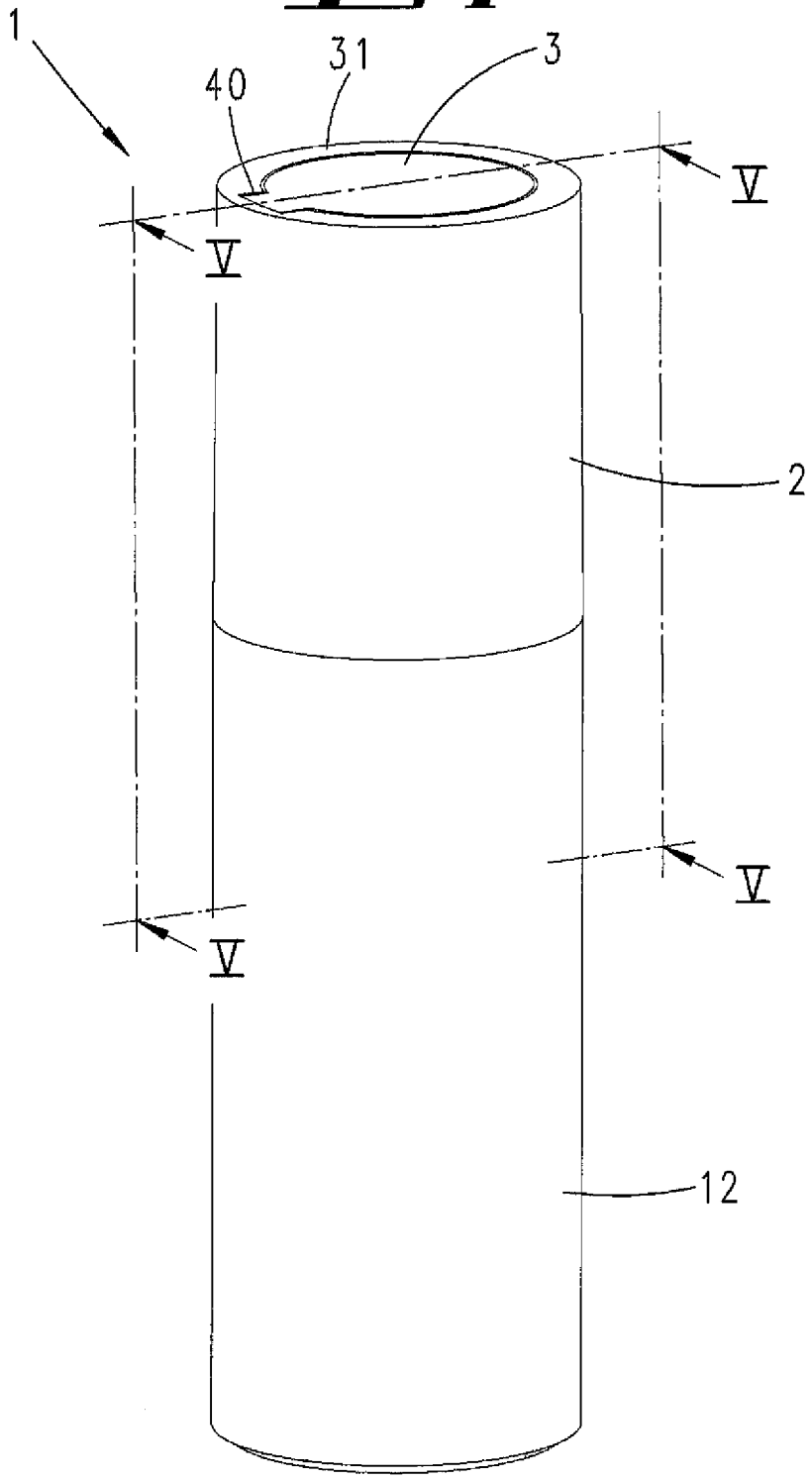
FIG. 1 shows an exterior view of the dispenser in the retracted state of the head part.
Figure 2:
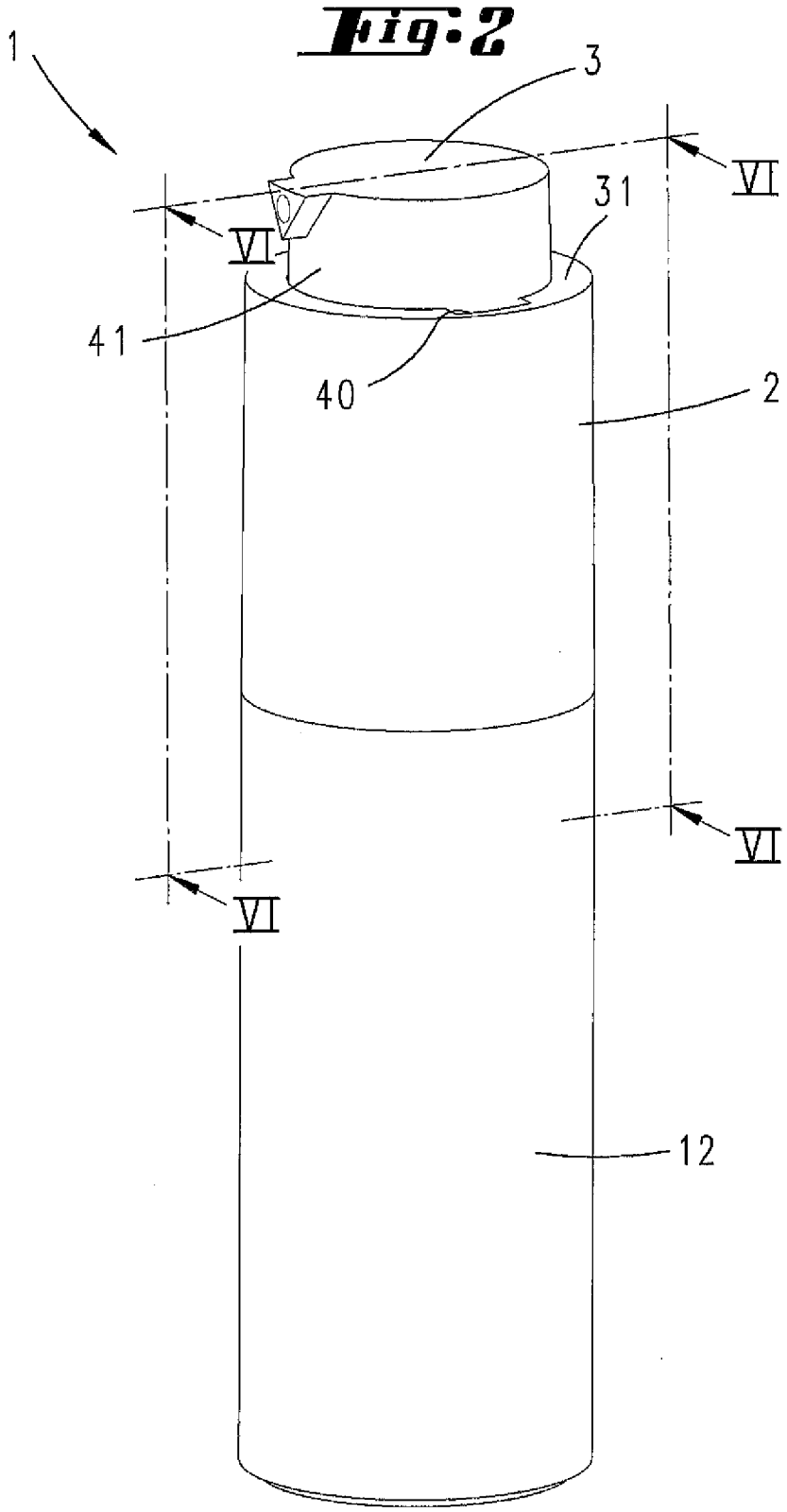
FIG. 2 shows an illustration according to FIG. 1 with extended head part.
Figure 5:
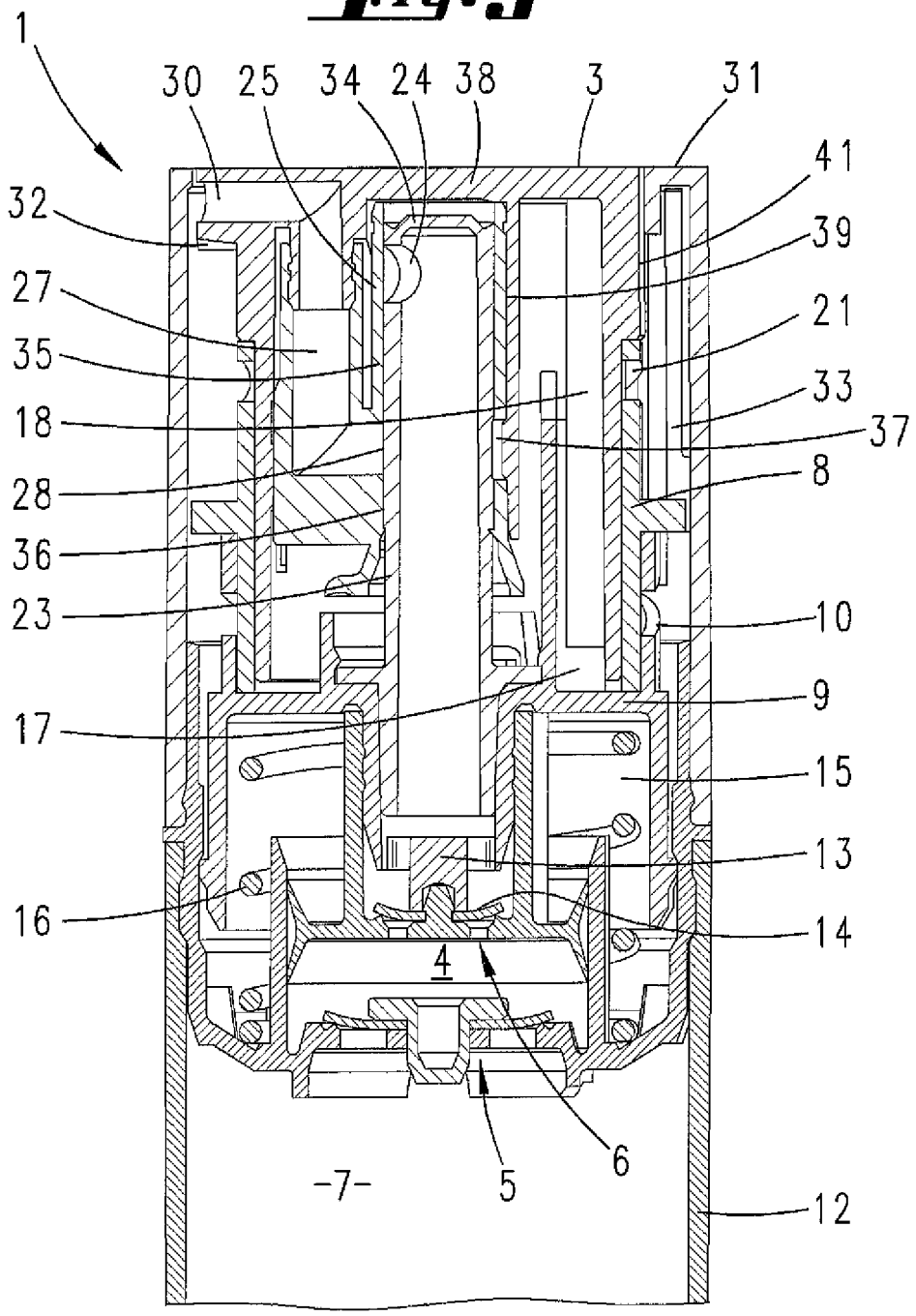
FIG. 5 shows a cross-section through the object according to FIG. 1, cut along the line V-V.

Illustrated and described is, in first instance with reference to FIGS. 1 and 2, a dispenser 1 that serves for dispensing liquid or pasty substances. Said dispenser comprises a dispensing head 3 accommodated in a dispenser head part 2 that forms at the same time the outer surface. The dispensing head 3 adjoins a pump chamber 4 at the top thereof; see, for example, FIG. 5. The pump chamber 4 has an inlet valve 5 and an outlet valve 6. It is also possible that only one valve is provided.

Below the pump chamber 4, a reservoir 7 is formed in which, for example, a follower piston can be disposed, which is not shown in detail here. Furthermore, disposed in the dispenser head part 2 is an insert 9 that has one or a plurality of slotted displacement guides 10 in which a sleeve part 8 runs by means of one or a plurality of cams 11. The insert 9 is preferably disposed in a rotationally locked manner relative to a sleeve part 12 that forms the reservoir or in any case surrounds the reservoir externally. The rotational lock can be provided here simply by frictional locking, for example, between the spring 16 mentioned below and the associated contact surfaces. The insert 9 is formed on one side with a holding part 13 that acts on the valve element 14 in a holding manner. On the other side, it forms a receiving chamber 15 which is open toward the bottom and in which the return spring 16 is accommodated. Furthermore, the insert 9 forms a vertical guide 17 that interacts with a guide counterpart 18 of the dispensing head 3. The mentioned parts or guides can also be provided in each case as separate parts. The vertical guide 17, as one piece or separately, can be formed from two vertically extending, peripherally offset strip elements that project radially on the outside of the insert 9. Correspondingly, the guide counterpart 18 can also be a vertically extending strip element. It can project radially inwardly and can be formed on a downwardly projecting cup-shaped wall of the dispensing head 3. The interaction of the vertical guide 17 and the guide counterpart 18 permits only an axial movement of the dispensing head 3. The dispenser head part 2 interacts with the sleeve part 8 by way of a positive locking driver 19 and consists of a projection 33 formed on the inside on the dispenser head part 2, said projection engaging in a corresponding recess 20 of the sleeve part 8. Said recess 20 can be formed on a horizontally and circumferentially extending, outwardly protruding radial projection of the sleeve part 8. Viewed over the periphery, a plurality of positive locking connections is formed between the dispenser head part 2 and the sleeve part 8. The projection 33 is preferably formed as a rib that extends only vertically. In the course of the displacement, said rib can move vertically in the recess 20.

Furthermore, the sleeve part 8 forms a slotted guide 21 in which a sliding block 22 (FIG. 3) runs that is formed here as a pin and is fixedly connected to the dispensing head 3.

Figure 3:
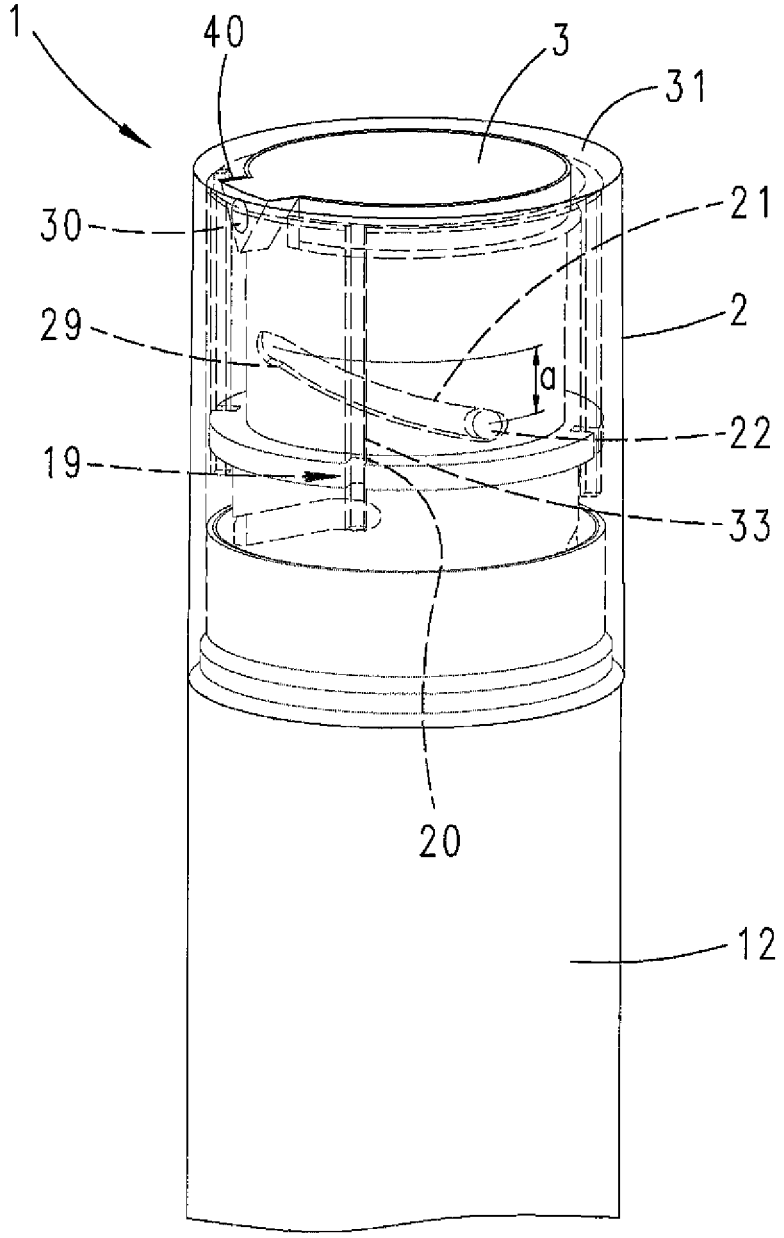
FIG. 3 shows an illustration according to FIG. 1 with a partial view through the dispenser head part.
Figure 4:
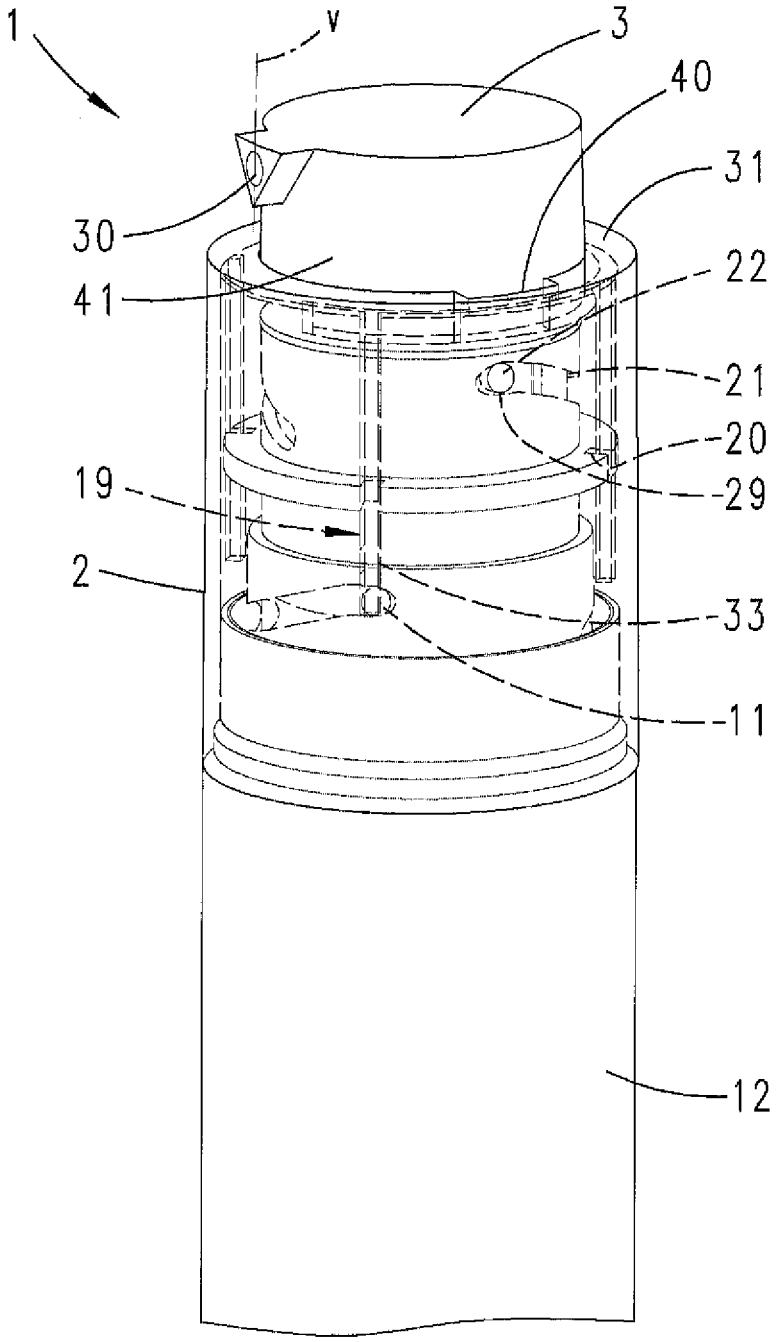
FIG. 4 shows an illustration according to FIG. 2 with a partial view through the dispenser head part.

When rotating the dispenser head part 2 from a position according to FIG. 3 to the right into the position according to FIG. 4, the sliding block 22, as can be seen, runs upward in such a manner that the dispensing head 3 moves upward. At the same time, the sleeve part 8 is lifted by means of the slotted guide 10 so that the result is a protrusion u of the dispensing head 3 beyond the opening, which protrusion is greater than corresponds to the height difference a through which the sliding block 22 passes during the rotation.

Figure 6:
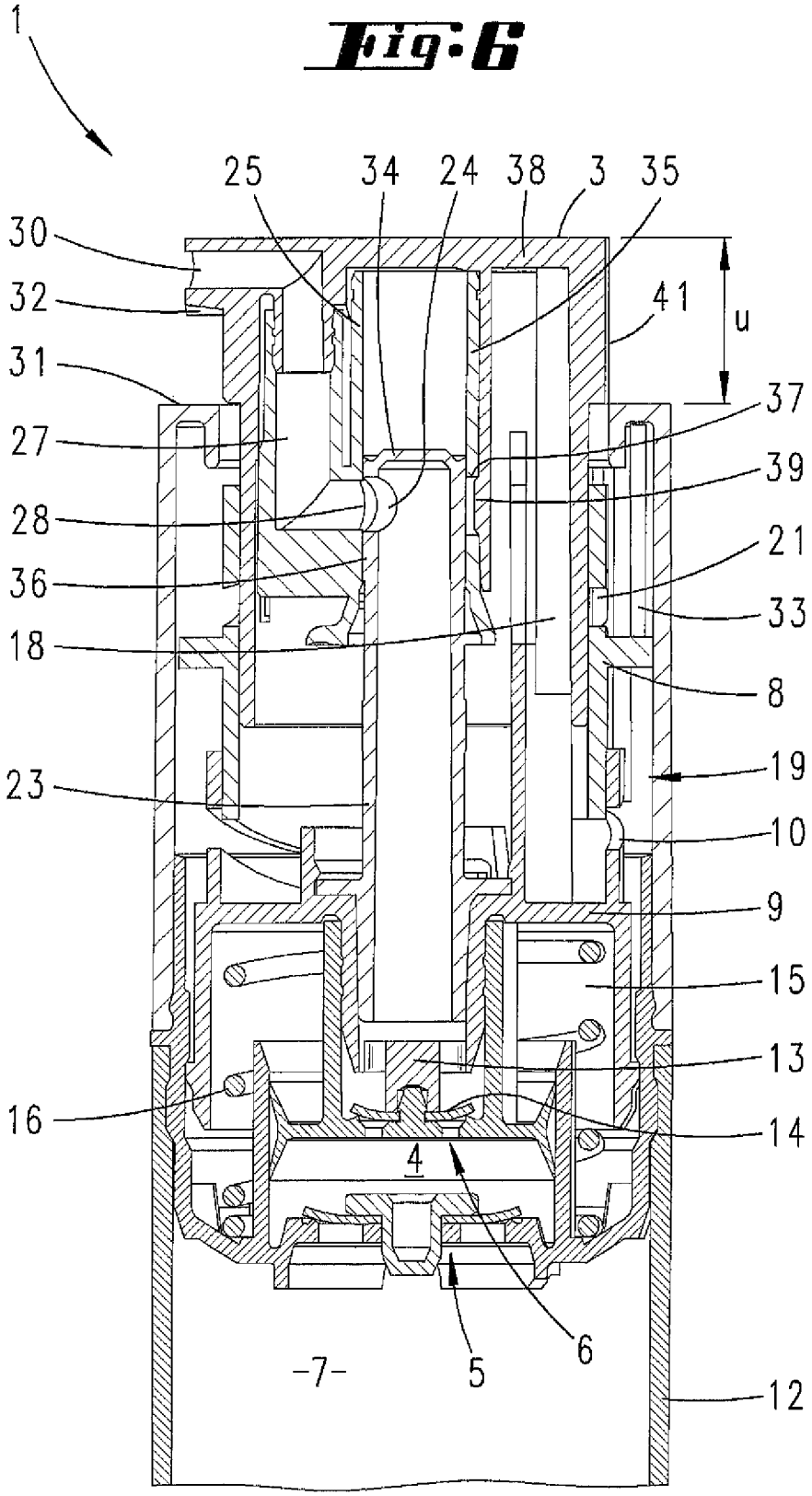
FIG. 6 shows a cross-section through the object according to FIG. 2, cut along the line VI-VI.

Beyond the outlet valve 6, a discharge tube 23 is connected to the pump chamber 4. When pressure acts on the dispensing head 3, this discharge tube 23 together with the insert 9 can be moved vertically downward for reducing the volume of the pump chamber 4 so as to dispense a corresponding volume of substance. At its upper end, the discharge tube 23 has an outlet opening 24. Furthermore, the discharge tube 23 is surrounded by a closure portion 25 of the dispensing head 3, which closure portion surrounds the discharge tube in the upper region. The closure portion 25 transitions in vertical directions into a dispensing head discharge tube 27 that has a mouth 28 which is associated with the discharge tube 23. When the dispensing head 3 moves vertically upward, said mouth 28 comes into alignment with the outlet opening 24. Thus, in the lowered state of the dispensing head 3, a quasi throttling of the outlet opening 24 is implemented by the closure portion 25. The discharge tube 23 does not need to move, except for a possible pump movement, but in this case by being quasi-rigidly coupled to the dispensing head discharge tube 27. Due to the stable position of the dispensing head in the vertically extended state, which, to be specific, is achieved in the exemplary embodiment by a horizontal portion 29 of the slotted guide 21 and, if necessary, by a horizontal portion of the slotted guide 10 upon which then the sliding blocks 22 and 11 act, respectively, a pumping movement can be carried out by pushing down the dispensing head 3 allowing then the substance, in the configuration of FIG. 6, to exit from the dispensing mouth 30, out of the pump chamber 4 through the discharge tube 23, the opening 24, the mouth 28 and the dispensing head discharge tube 27.

It is advantageous here that an end face region 31 of the dispenser head part 2 can be formed in a closed-end manner vertically below the dispensing mouth 30, since the dispensing mouth 30 retracts only into this wall region 31, merely offset in dimension relative thereto and despite the projecting portion 32; see also, for example, FIGS. 1 and 2 in comparison with each other.

Apart from that, the dispenser is formed according to the dispenser as described in the aforementioned WO 2009/127651 A1. In this regard, the disclosure content of the mentioned published WO specification is hereby included in full in the disclosure of this application, including for the purpose of incorporating one or a plurality of features of the mentioned published WO specification in claims of the present application.

At its end facing the dispensing head 3, the discharge tube 23 is closed by a substantially horizontal end wall 34. The part forming the dispensing head discharge tube 27 forms also, in the vertical direction on both sides of the mouth 28, a guide portion 35 above the mouth 28 and a guide portion 36 below the mouth 28, respectively. Opposite to this mouth 28, a through hole 37 is formed in this part. Said through hole is utilized for a locking connection with a connection part 39 that projects downwardly from the inside of a top region 38 of the dispensing head 3. Furthermore, the dispensing head discharge tube 27 is partially formed in the aforementioned part and partially formed in the part of the dispensing head 3 that also forms the wall 38. In the retracted state, see FIG. 1, preferably a planar alignment of the outer surface of the wall 38 with the end face region 31 of the dispenser head part 2 is provided.

The portion 32 that forms the dispensing mouth 30 and that projects with respect to the otherwise circularly formed region of the dispensing head 3 and in any case however with respect to an engaging wall 41, is retracted into a retraction opening 40 of the dispenser head part 2. The retraction opening 40 is formed in the wall region 31.

As an alternative to the directly fitting engaging position between the contour of the portion 32 and the corresponding opening contour of the retraction opening 40, as given in the exemplary embodiment, the retraction opening 40 can be formed in the peripheral direction, in any case in its radial portion, with such a spacing from the portion 32 that forming an oblique surface on the portion 32 and/or the retraction opening 40 is not required (but nevertheless can be provided).

All features disclosed are (in themselves) pertinent to the invention. The disclosure content of the associated/accompanying priority documents (copy of the prior application) is also hereby included in full in the disclosure of the application, including for the purpose of incorporating features of these documents in claims of the present application. The subsidiary claims in their optional subordinated formulation characterize independent inventive refinement of the prior art, in particular to undertake divisional applications based on these claims.

LIST OF REFERENCE SIGNS

1 Dispenser
2 Dispenser head part
3 Dispensing head
4 Pump chamber
5 Inlet valve
6 Outlet valve
7 Reservoir
8 Sleeve part
9 Insert
10 Slotted displacement guide
11 Cam
12 Sleeve part
13 Holding part
14 Valve element
15 Receiving chamber
16 Return spring
17 Vertical guide
18 Guide counterpart
19 Positive locking driver
20 Recess
21 Slotted guide
22 Sliding block
23 Discharge tube
24 Outlet opening
25 Closure portion
26
27 Dispensing head discharge tube
28 Mouth/cross-section
29 Horizontal portion
30 Dispensing mouth
31 End face region
31 Portion
33 Projection
34 End wall
35 Guide portion
36 Guide portion
37 Through hole
38 Top region/wall
39 Connection part
40 Retraction opening
41 Engaging wall
u Protrusion beyond opening
a Height difference
v Vertical axis of the dispenser

The invention claimed is:

1. A dispenser for dispensing liquid or pasty substances, with a dispensing head having a dispensing mouth, and with a reservoir and a dispenser head part, the dispensing head being movable relative to the dispenser head part by a rotational movement of the dispenser head part from a dispenser stand-by position into a lowered position and vice versa, wherein the dispenser head part moves the dispensing head in and out only axially, the dispensing head being connected in a rotationally locked manner to a stationary part of the dispenser, wherein a sleeve part that is rotatable relative to the dispenser reservoir and/or a pump chamber acts on the dispensing head for a vertical movement, wherein the dispenser further has an insert disposed in the dispenser head part, has a vertical guide disposed on one of the insert and the dispensing head, has a guide counterpart disposed on the other of the insert and the dispensing head, the guide counterpart interacting with the vertical guide to permit only the vertical movement of the dispensing head, and wherein the dispenser head part interacts with the sleeve part by way of a projection formed on the inside on the dispenser head part, said projection engaging in a corresponding recess of the sleeve part.

2. The dispenser according to claim 1, wherein the dispenser head part has a retraction opening for the dispensing mouth of the dispensing head, which dispensing mouth projects at least partially relative to an engaging wall, and wherein the dispensing mouth has side walls running obliquely to a vertical axis of the dispenser.

3. The dispenser according to claim 1, wherein the stationary part of the dispenser is the dispenser reservoir and/or a pump chamber.

4. The dispenser according to claim 1, wherein in the course of the rotation, the sleeve part performs an axial movement.

5. The dispenser according to claim 1, wherein the dispenser has a lower sleeve part forming the reservoir or surrounding the reservoir, and wherein the dispensing head part is connected to the lower sleeve part to prevent vertical movement of the dispensing head part.

* * * * *